US005213490A

United States Patent [19]

Yamamoto et al.

[11] Patent Number: 5,213,490

[45] Date of Patent: May 25, 1993

[54] SCROLL-TYPE COMPRESSOR WITH DISCHARGE OPENING ABOVE THE LUBRICANT RESERVOIR

[75] Inventors: Shuichi Yamamoto, Otsu; Osamu Aiba; Michio Yamamura, both of Kusatsu, all of Japan

[73] Assignee: Matsushita Electric Industrial Co., Ltd., Osaka, Japan

[21] Appl. No.: 688,598

[22] PCT Filed: Nov. 2, 1990

[86] PCT No.: PCT/JP90/01416

§ 371 Date: Sep. 3, 1991

§ 102(e) Date: Sep. 3, 1991

[87] PCT Pub. No.: WO91/06768

PCT Pub. Date: May 16, 1991

[30] Foreign Application Priority Data

Nov. 2, 1989 [JP] Japan ..... 1-287014

[51] Int. Cl.[5] ..... F04C 18/04; F04C 29/02

[52] U.S. Cl. ..... 418/55.6; 418/96

[58] Field of Search ..... 418/55.6, 95, 96, DIG. 1

[56] References Cited

U.S. PATENT DOCUMENTS

| | | | |
|---|---|---|---|
| 4,755,114 | 7/1988 | Shibayashi et al. | 418/55.6 |
| 4,854,831 | 8/1989 | Etemad et al. | 418/55.6 |
| 5,037,278 | 8/1991 | Fujio et al. | 418/55.6 |

FOREIGN PATENT DOCUMENTS

| | | | |
|---|---|---|---|
| 58-15787 | 1/1983 | Japan . | |
| 60-39517 | 11/1985 | Japan . | |
| 60-243390 | 12/1985 | Japan | 418/55.6 |
| 63-119888 | 8/1988 | Japan . | |
| 64-32093 | 2/1989 | Japan . | |
| 1-177452 | 7/1989 | Japan . | |
| 1-177482 | 7/1989 | Japan . | |
| 1-219384 | 9/1989 | Japan | 418/55.6 |

*Primary Examiner*—John J. Vrablik

*Attorney, Agent, or Firm*—Stevens, Davis, Miller & Mosher

[57] ABSTRACT

A scroll-type compressor has a stationary scroll frame 7 on which a discharge muffler 24 is provided so as to form a first discharge space 24*a*. First and second discharge passages 25, 26 are formed to extend through the stationary scroll frame 7 and a bearing 20 so as to provide communication between the first discharge space 24*a* and the interior of the hermetic container 1. The second communication hole opens in the interior of the hermetic container 1 through a guide member 29 at a level above the level of a lubricating oil in a lubricant reservoir 31. Since the opening of the second communication hole into the hermetic container is set by the guide member 29 at a level above the oil level in the lubricant reservoir 31, the discharge passage can be formed easily without requiring any special component which defines the passage.

5 Claims, 6 Drawing Sheets

SCROLL-TYPE COMPRESSOR WITH DISCHARGE OPENING ABOVE THE LUBRICANT RESERVOIR

TECHNICAL FIELD

The present invention relates to a scroll-type motor-driven compressor.

BACKGROUND ART

A conventional scroll-type compressor having a lower portion forming a compression mechanism and an upper portion forming a motor portion has a construction as shown in Japanese Patent Laid-Open No. 1-177452. FIG. 1 shows such a compressor in vertical section. Referring to this Figure, numeral 50 denotes a stationary scrollmember having a stationary scroll end plate 51 and a stationary scroll wrap 52. An orbiting scroll member 53 has an orbiting scroll end plate 54 and an orbiting scroll wrap 55. The stationary and orbiting scroll members mesh with each other so as to form a compression space 56. Numerals 57 and 58 denote a discharge port and a discharge communication pipe. The discharge communication pipe 58 is led out of a hermetic container 59 and is again led into the hermetic container 59. Numeral 60 denotes a mechanism for preventing the orbiting scroll member 53 from rotating about its own axis. A drive shaft 64 is borne by a bearing 61 which includes both the main bearing 62 and a sub-bearing 63. Numerals 65, 66 denote a stator and a rotor of an electric motor 67, respectively. The rotor 66 fits on the drive shaft 64 so as to transmit torque to the orbiting scroll member 53. Lubricating oil is supplied to sliding parts in the bearing from a lubricant reservoir 68 which is defined between the bearing 61 and the electric motor 67. A balance weight 69 attached to the rotor 66 of the electric motor 67 i exposed to the lubricant reservoir 68. In operation, a compressed gas discharged from the stationary scroll end plate 51 is introduced into a lower space in the hermetic container 59 and is then returned into the hermetic container 59 through the pipe 58 so as to cool the electric motor 67. Oil suspended by the discharge gas after cooling is then separated from the gas within the hermetic container 59. The gas free of oil is then delivered to the exterior of the compressor through the discharge pipe 70. Meanwhile, oil separated from the gas is collected in a lubricant reservoir 68.

This known apparatus has suffered from problems such as increase in the noise and vibration of the whole system as the pulsation by the discharged gas is directly transmitted to the exterior of the compressor. Furthermore, an additional communication pipe has to be provided for the purpose of introducing the discharged gas into the hermetic container.

Furthermore, there is a risk that, when the position where the discharged gas is returned into the hermetic container has not been adequately determined, the lubricating oil in the lubricant reservoir is blown by the returned gas so as to cause a shortage of the lubricant oil. When the gas discharge passage is formed by, for example, a pipe, the resonance vibration of the pipe is directly transmitted to the hermetic container to excite or amplify the pulsation of the pressure inside the hermetic container, with the result that the noise from the compressor is undesirably increased.

It is also to be pointed out that the balance weight exposed to the lubricant reservoir agitates the lubricating oil in the reservoir so as to incur a wasteful power loss.

Furthermore, presence of a space of a comparatively large volume under the compressor, forming a part of the discharge passage, undesirably allows stagnation of the lubricating oil contained in the discharged gas, resulting in a lowering of the level in the lubricating oil reservoir and, hence, in a shortage of the lubricating oil to be supplied to various sliding portions in the compressor.

DISCLOSURE OF THE INVENTION

In order to overcome the above-described problems of the prior art, the present invention provides a scroll-type compressor comprising: a hermetic container; an electric motor disposed in the hermetic container; and a compression mechanism disposed in the hermetic container and driven by the electric motor, the compression mechanism including a stationary scroll member having a stationary scroll frame and a stationary scroll wrap formed integrally with the frame, an orbiting scroll member having an orbiting scroll end plate and an orbiting scroll wrap which is fixed to or formed on the orbiting scroll end plate and which meshes with the stationary scroll wrap so as to define therebetween a plurality of compression working chambers, a mechanism for preventing the orbiting scroll member from rotating about its own axis, a crankshaft for driving the orbiting scroll member for an eccentric orbiting motion, and a bearing for supporting the main shaft portion of the crankshaft, the compressor further comprising a discharge muffler provided on the stationary scroll frame and forming a first discharge space, first and second discharge passages formed in the stationary scroll frame and the bearing so as to provide a communication between the first discharge space and the interior of the hermetic container; and a guide member through which the second communication hole opens in the interior of the hermetic container at a level above the lubricating oil level in a lubricant reservoir.

Third and fourth discharge passages may be provided in symmetry with the first and second discharged passages, so as to provide communication between the discharge muffler and the interior of the hermetic container.

The first and second discharge passages extending through the stationary scroll frame and the bearing may include a second discharge space provided on the bearing and defined by the bearing and the guide member.

The guide member may include a contact surface contacting the bearing, and an isolating portion which isolates the main shaft from the oil reservoir in the hermetic container, the guide member being provided on the bearing such that the isolating portion opens to the interior of the hermetic container at a level above the level of the lubricating oil.

THE BEST MODE FOR CARRYING OUT THE INVENTION

Figure 1:
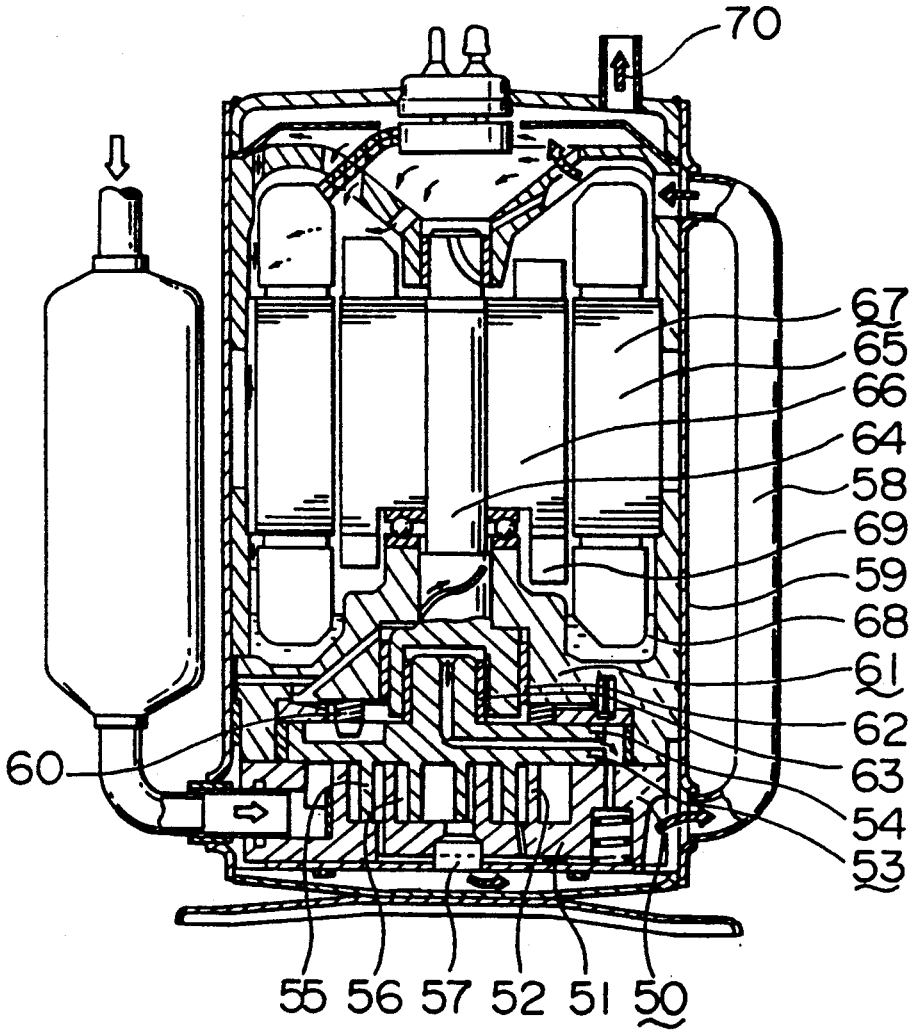
FIG. 1 PRIOR ART
FIG. 1 is a vertical sectional view of a known scroll-type compressor.
Figure 2:
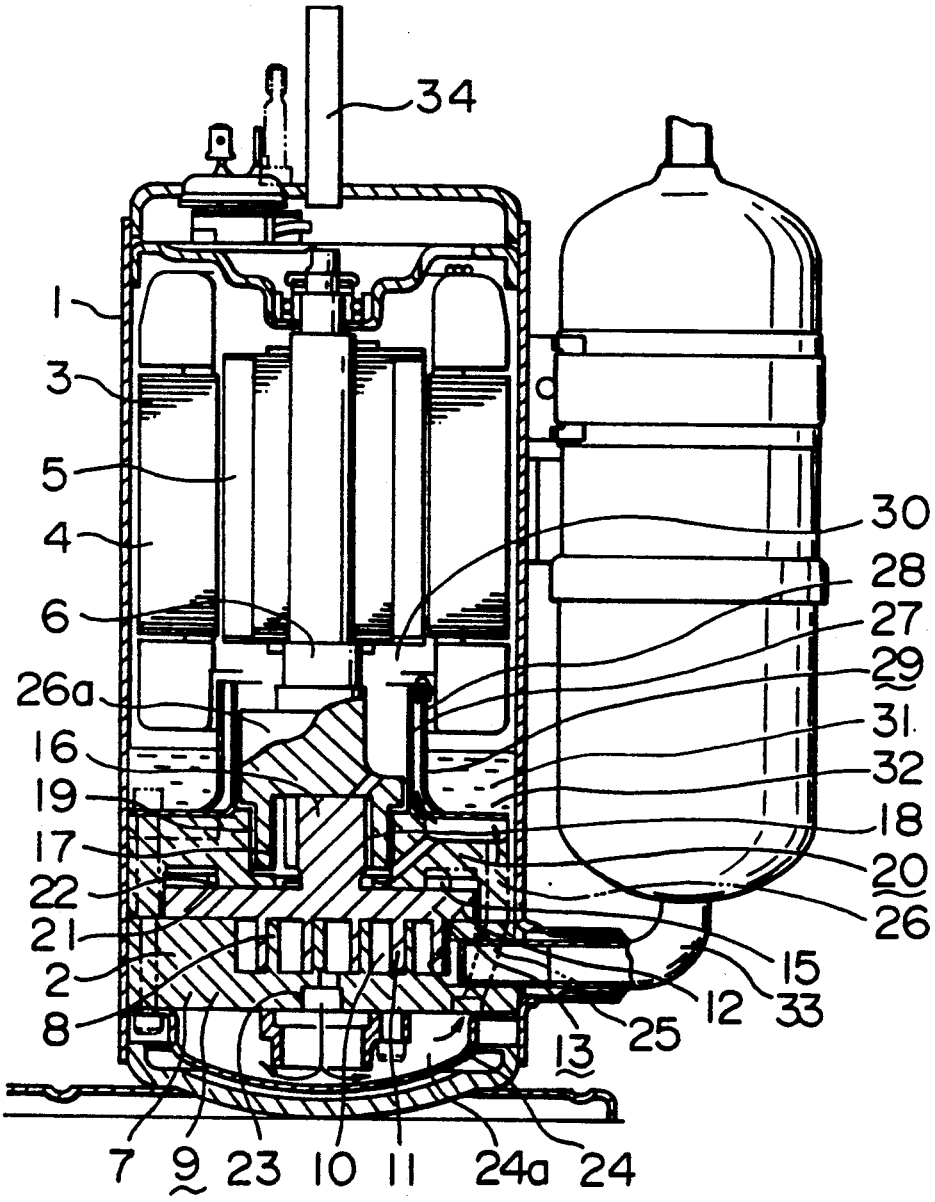
FIG. 2 is a vertical sectional view of an embodiment of the scroll-type compressor of the present invention.

Embodiments of the present invention will be described with reference to the drawings. Referring to FIG. 2 showing the first embodiment, a compression mechanism 2 is fixed in a lower portion of the hermetic container 1. An electric motor 3 for driving the compression mechanism 2 has a stator 4 which is fixed in an upper portion of the hermetic container 2. The electric motor 3 also has a rotor 5 which is connected to a crankshaft 6 for driving the compression mechanism 2. The compression mechanism has the following components: a stationary scroll member 9 having a stationary scroll frame 7 and a stationary scroll wrap 8 formed integrally with the frame 7; an orbiting scroll member 13 having an orbiting scroll end plate 12 and an orbiting scroll wrap 11 formed integrally on the end plate 12, the orbiting scroll wrap 11 meshing with the stationary scroll wrap 8 to form therebetween a plurality of compression working chambers 10; a mechanism 15 which prevents the orbiting scroll member 13 from rotating about its own axis, thus ensuring that the orbiting scroll member 13 makes an orbiting motion without rotation; an orbiting driving shaft 16 provided on the opposite side of the orbiting scroll end plate 12 to the orbiting scroll wrap 11; a bearing 20 including an eccentric bearing 18 provided in the main shaft 17 of the crankshaft 6 and adapted for driving the orbiting drive shaft 16 and extending no longer than the length of shaft 16, the bearing 20 also including a main bearing 19 for supporting the main shaft 17 of the crankshaft 6; and a back-pressure partition ring 21 which radially partitions the back pressure on the orbiting end pate 12 in the radial direction. A gas pressure lower than the gas pressure at the discharge side of the compressor acts on the side of the orbiting scroll end plate 12 to the orbiting scroll wrap 11. The gas compressed in the compression chambers 10 is discharged from a discharge port 23 which is formed in the stationary scroll frame disposed in the lower portion of the compression mechanism 2. The compressed gas discharged from the discharge port 23 is then introduced into a first discharge space 24*a* in a discharge muffler 24 provided in the stationary scroll frame. Lubricating oil contained in the compressed gas is separated to some extent from the compressed gas. The compressed gas is then made to flow through communication holes 25 and 26 which penetrate the stationary scroll frame 7 and the bearing 20. A guide member 29, which is provided on the bearing 20, has a contact surface which contacts the bearing 20, a cylindrical portion 27 which surrounds the main shaft 17 of the crankshaft 6 and the balance weight 26*a*, and a guide portion 28 which is provided along the cylindrical portion 27. The compressed gas introduced to the first and second communication holes is discharged into a space 30 between the electric motor 3 and the compression mechanism 2, through the guide portion 28. A lubricant reservoir 31 provided under the space 30 holds a lubricating oil 32 which is to be supplied to various sliding portions. A refrigerant gas sucked through a suction pipe 33 of the compressor is compressed by the compression mechanism 2 inside the hermetic container 1 and is discharged from the discharge port 23 into the space 30 via the first and second communication holes 25, 26 and the guide member 29. The compressed gas discharged into the space 30 cools the electric motor 3 and then forwarded to the exterior of the compressor through the discharge pipe 34. The space inside the muffler and the space 30 between the electric motor 3 and the compression mechanism 2 are communicated with each other through the first and second communication holes 25 and 26 which are directly formed in the stationary scroll frame 7 add the bearing 20, so that the compressed gas discharged to the space under the compression mechanism can easily be introduced to an upper portion of the interior of the hermetic container without requiring any special part. In addition, since the guide member 29 opens at a level above the level of the lubricating oil in the lubricant reservoir 31, there is no risk of blowing of the lubricating oil which, in the known compressors of this type, occurs due to introduction of the compressed gas into the lubricating oil. Consequently, a required oil level is always maintained in the lubricant reservoir, thus offering a high reliability of the compressor.

Figure 3:
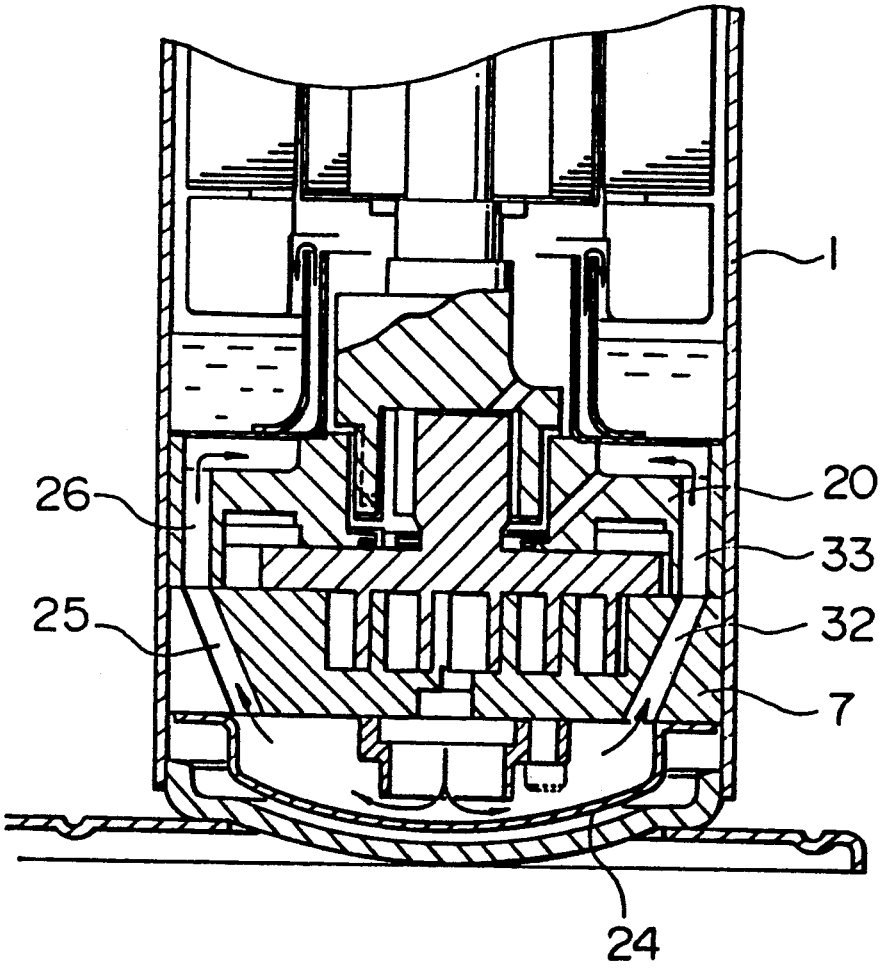
FIG. 3 is a vertical sectional view of a second embodiment of the present invention.

A second embodiment of the invention will be described with reference to FIG. 3. In this Figure, the same reference numerals are used to denote the same parts or components as those used in the first embodiment, and detailed description of such parts or members is omitted. Numerals 32 and 33 denote third and fourth communication holes which are provided on the stationary scroll frame 7 and the bearing 20 and which are disposed in symmetry with the first and second communication holes 25 and 26, so as to provide a communication between the interior of the muffler 24 and the space under the electric motor. According to this arrangement, the compressed gas discharged from the compression mechanism is divided into two parts which flow with a certain phase difference so that the level or amplitude of the pulsation is reduced by virtue of the interference of these two flows, whereby the noise and vibration transmitted to the exterior of the compressor are diminished.

Figure 4A:
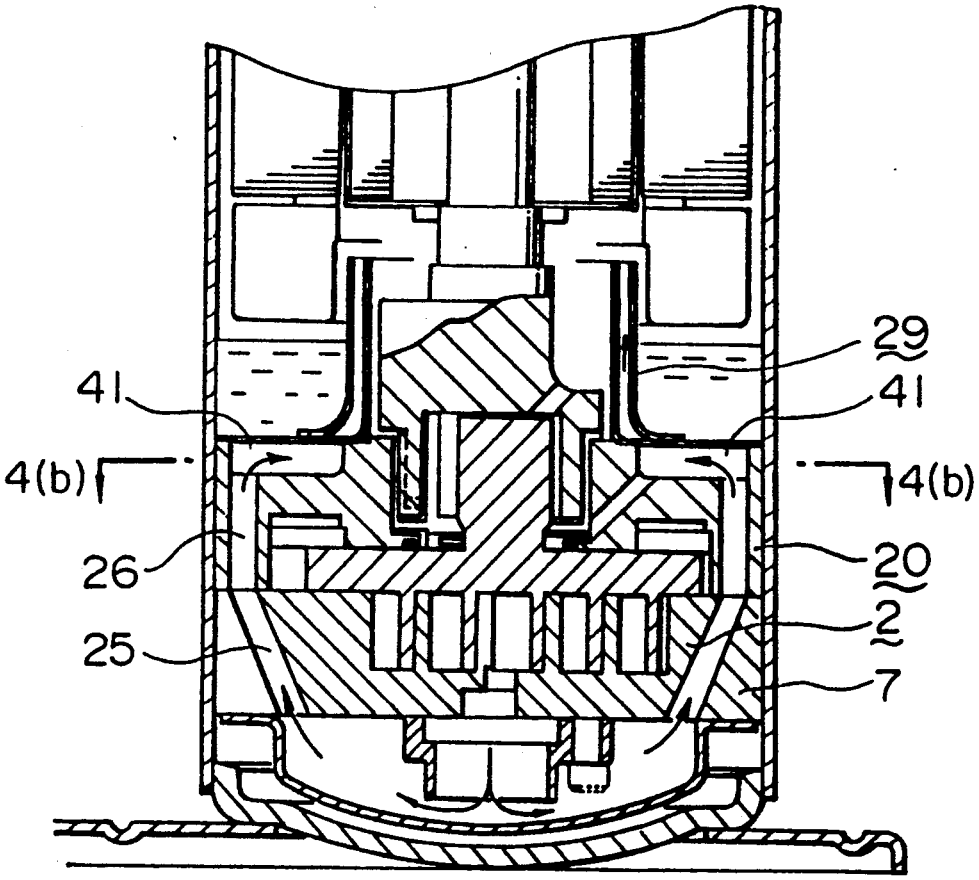
FIGS. 4(a) and 4(b) illustrate an additional future, of the present invention wherein FIG. 4(*a*) is a vertical sectional view and FIG. 4(*b*) is a sectional view taken along a line 4(*b*)–4(*b*)
Figure 4B:
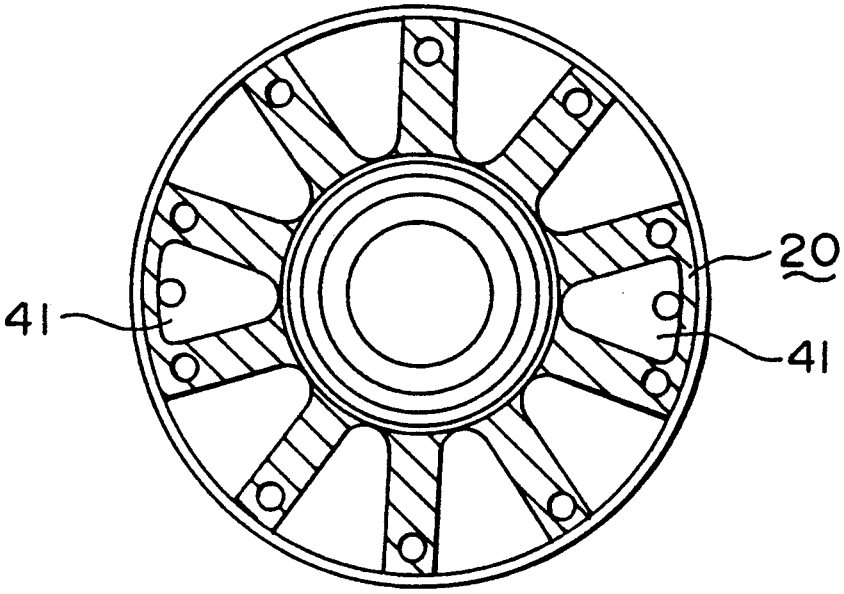

A description will now be given of an alternative feature of the present invention with reference to FIG. 4. Numeral 41 denotes a second discharge space which is formed on the bearing 20 and defined by the contact surface of the guide member 29 and the bearing 20. The compressed gas discharged from the compression mechanism 2 is introduced into this second discharge space 41 through the first and second communication holes 25 and 26. According to this arrangement, the amplitude of the pulsation of the compressed gas is reduced as the gas passes through the second discharge space 41, so that the pulsation of the compressed gas discharged to the interior of the hermetic container is greatly reduced to suppress noise and vibration transmitted to the exterior of the compressor. The second discharge space 41 can easily be formed without requiring any additional part or member.

Figure 5A:
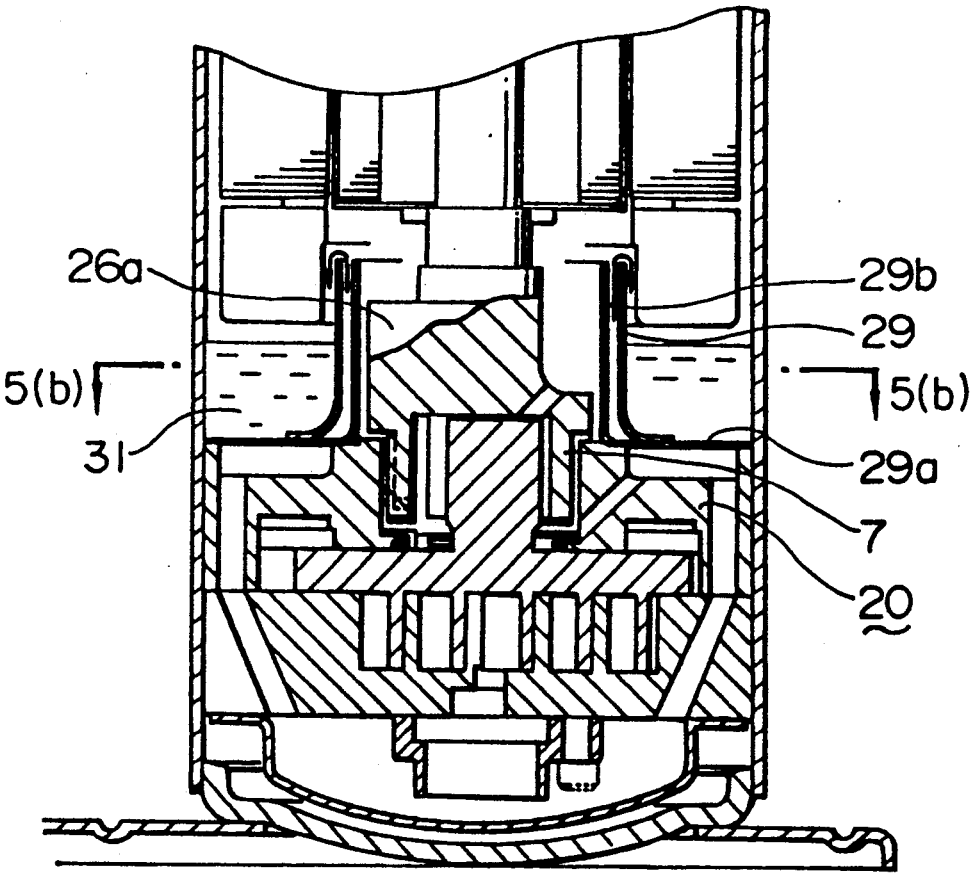
FIGS. 5(*a*) and 5(*b*) illustrate an additional feature of the present invention, wherein FIG. 5(*a*) is a vertical sectional view and FIG. 5(*b*) is a sectional view taken along a line 5(*b*)–5(*b*)
Figure 5B:
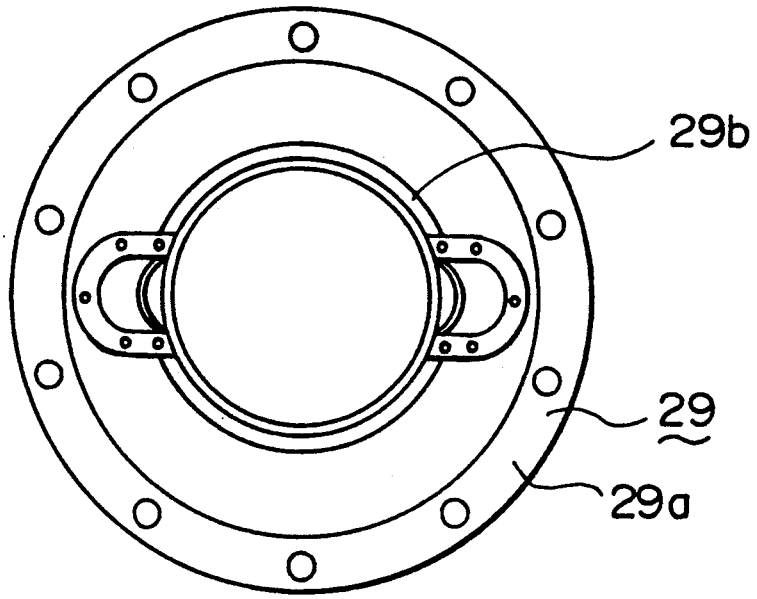

An additional feature will be described with reference to FIG. 5. Reference numeral 29 denotes a guide member which is provided in the bearing 20 supporting the main shaft 17. The guide member 29 completely isolates the lubricating oil 32 in the lubricant reservoir 31 from a balance weight 26*a* provided on the main shaft 7. The balance weight 26*a*, therefore, never agitates the lubricating oil. In consequence, loss of power due to agitation of the lubricating oil is eliminated to offer an improvement in the efficiency of the compressor.

Figure 6A:
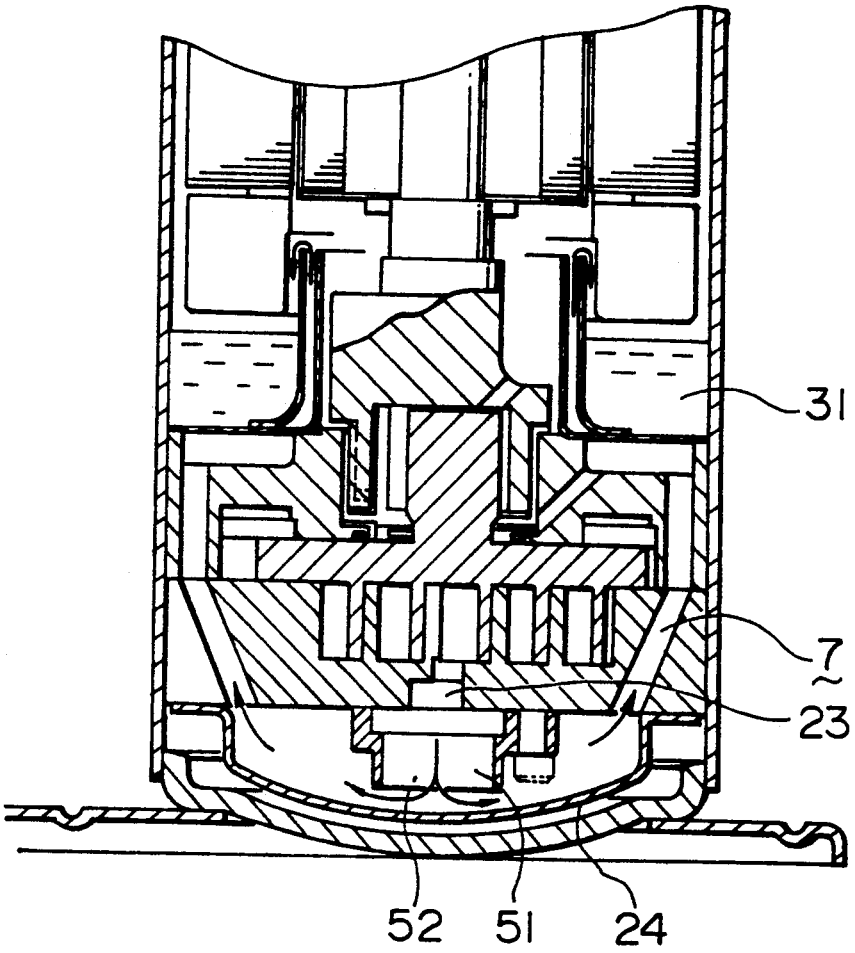
FIGS. 6(*a*) and 6(*b*) illustrate an additional feature of the present invention, wherein FIG. 6(*a*) is a vertical sectional view and FIG. 6(*b*) is a perspective view of an essential portion of the discharge guide plate.
Figure 6B:
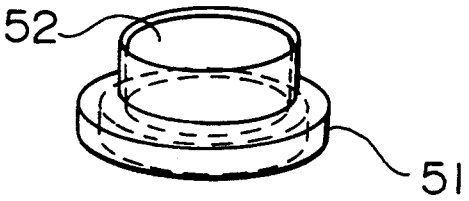

Yet another features of the present invention will be described with reference to FIG. 6. Referring to this Figure, numeral 51 denotes a discharge guide plate disposed adjacent the discharge port 23 provided on the lower end of the stationary scroll frame 7. The discharge guide plate extends in a columnar form in the direction of flow of the discharged compressed gas. The discharge guide plate has an opening 52 which is positioned in the vicinity of the muffler. The lubricating oil suspended by the discharged gas introduced from the discharge port 23 into the muffler 24 tends to stagnate in the bottom portion of the muffler, particularly when the flow velocity of the gas is low due to low-speed operation of the compressor. In this embodiment, however, the discharged gas is relieved to a region near the bottom of the muffler 24, so that any pool of lubricating gas stagnant on the bottom of the muffler is directly blow off by the discharged gas. As a consequence, the lubricating oil is collected without stagnating on the bottom of the muffler and is supplied again into various sliding portions, thus contributing to improvement in the reliability of the compressor.

INDUSTRIAL APPLICABILITY

According to the invention, there is provided a scroll-type compressor comprising: a hermetic container; an electric motor disposed in the hermetic container; and a compression mechanism disposed in the hermetic container and driven by the electric motor, the compression mechanism including a stationary scroll member having a stationary scroll frame and a stationary scroll wrap formed integrally with the frame, an orbiting scroll member having an orbiting scroll end pate and an orbiting scroll wrap which is fixed to or formed on the orbiting scroll end plate and which meshes with the stationary scroll wrap so as to define therebetween a plurality of compression working chambers, a mechanism for preventing the orbiting scroll member from rotating about its own axis, a crankshaft for driving the orbiting scroll member for an eccentric orbiting motion, and a bearing for supporting the main shaft portion of the crankshaft, the compressor further comprising a discharge muffler provided on the stationary scroll frame and forming a first discharge space, first and second discharge passages formed in the stationary scroll frame and the bearing so as to provide a communication between the first discharge space and the interior of the hermetic container; and a guide member through which the second communication hole opens in the interior of the hermetic container at a level above the lubricating oil level in a lubricant reservoir. With this arrangement, it is possible to easily form the discharge passage without using any special component defining the passage. In addition, since the direct blowing of lubricating oil off the lubricant reservoir by the discharged gas is eliminated, required amount of lubricating oil is held in the hermetic container without being conveyed to the exterior.

In one form of the present invention, third and fourth discharge passages are provided in symmetry with the first and second discharge passages, so as to provide communication between the discharge muffler and the interior of the hermetic container. According to this arrangement, the discharged gas is divided into two portions which flow through the symmetric discharge passages, so as to reduce the level of pulsation through mutual phase interference.

In another form of the invention, first and second discharge passages extending through the stationary scroll frame and the bearing include a second discharge space provided on the bearing and defined by the bearing and the guide member. In this form of the invention, the pulsation of the discharged gas can easily be reduced to reduce the noise of the compressor, without requiring any special pulsation absorption mechanism.

In still another form of the invention, the guide member may include a contact surface contacting the bearing, and an isolating portion which isolates the main shaft from the oil reservoir in the hermetic container, the guide member being provided on the bearing such that the isolating portion opens to the interior of the hermetic container at a level above the level of the lubricating oil. Consequently, the lubricating oil in the lubricant reservoir is isolated from the main shaft so that agitation of the lubricating oil by the balance weight on the main shaft takes place. Consequently, the efficiency of the compressor is improved by virtue of reduction in the loss of power.

In a further form of the present invention, the scroll-type compressor further comprises a columnar discharge guide plate provided around the discharge port formed in the stationary scroll frame and extending in the direction of flow of the discharged gas, the discharge guide plate opening at its end opposite to the discharge port in a region adjacent to the muffler. The lubricating oil separated from the discharged gas and accumulated on the bottom of the compression mechanism tends to stagnate within the mufflet particularly when the compressor is operating at a low speed. With the arrangement of the further form of the invention, however, the discharged gas sufficiently blows up the lubricating oil even when the compressor is operating at a low speed. As a consequence, the lubricating oil sucked by the compression mechanism is returned to the oil reservoir in the hermetic container without fail and supplied again to various portions demanding lubrication, thus ensuring a high reliability of the compressor.

We claim:

1. A scroll-type compressor, comprising: a hermetic container having an interior region; an electric motor having a stator and a rotor which are disposed in an upper part of said hermetic container; and a compression mechanism disposed in said hermetic container and below said electric motor, said compression mechanism being driven by said electric motor and comprising: a stationary scroll member having a stationary scroll frame and a stationary scroll wrap intregrally formed with said stationary scroll frame; an orbiting scroll member having an orbiting scroll end-plate, an orbiting scroll wrap formed on said orbiting scroll end-plate and an orbiting driving means provided on the orbiting scroll end-plate on the side opposite the orbiting scroll wrap, whereby said orbiting scroll wrap meshes with said stationary scroll wrap so as to define therebetween a plurality of compression working chambers; a mechanism for preventing said orbiting scroll member from rotating about its own axis; a crankshaft provided with a main shaft portion which is operatively connected to said orbiting driving means and an auxiliary shaft portion which extends from said main shaft portion and is connected to the rotor of said electric motor, for driving said orbiting scroll member in an eccentric orbiting motion; and a bearing for supporting only the main shaft portion of said crankshaft, said main shaft portion extending no longer than the length of the orbiting driving means; said compressor further comprising: a lubricant oil reservoir provided between said compression mechanism and said electric motor; a discharge muffler provided on said stationary scroll frame and defining a first discharge space; first and second communication passages formed respectively in said stationary scroll frame and said bearing so as to provide communication between said first discharge space and the interior region of said hermetic container; and a guide member disposed around said crankshaft and provided with an opening at a level higher than the lower end of the stator of said electric motor, through which guide member said second communication passage opens into the interior region of said hermetic container at a level above a lubricating oil level in said lubricant reservoir.

2. A scroll-type compressor according to claim 1, wherein said first and second communication passages are provided in plural in symmetry, so as to provide communication between said discharge muffler and the interior region of said hermetic container.

3. A scroll-type compressor according to claim 1, wherein said first and second communication passages extending through said stationary scroll frame and said bearing include a second discharge space provided on said bearing and defined by said bearing and said guide member.

4. A scroll-type compressor according to claim 1, wherein said guide member includes a contact surface contacting said bearing, and an isolating portion which isolates said main shaft portion from said oil reservoir in said hermetic container, said guide member being provided on said bearing so that said isolating portion opens to the interior region of said hermetic container at a level above the level of the lubricating oil.

5. A scroll-type compressor according to claim 1, further comprising a columnar discharge guide plate provided around a discharge port formed in the stationary scroll frame and extending in the direction of flow of the discharged gas, said discharge guide plate opening at its end opposite to said discharge port in a region adjacent to said muffler.

* * * * *